United States Patent [19]

Nicholson

[11] 3,937,050

[45] Feb. 10, 1976

[54] APPARATUS FOR CONSTRICTING OR CLOSING CONDUITS

[75] Inventor: James Nicholson, Stockton-on-Tees, England

[73] Assignee: Imperial Chemical Industries Limited, London, England

[22] Filed: Oct. 31, 1974

[21] Appl. No.: 519,658

[30] Foreign Application Priority Data

Nov. 6, 1973 United Kingdom ..... 51429/73

[52] U.S. Cl. ..... 72/453; 72/416; 72/455; 100/231; 166/55; 251/5

[51] Int. Cl.² ..... B21D 7/00

[58] Field of Search ..... 72/453, 410, 455, 416; 100/231; 251/1, 5; 166/55

[56] References Cited

UNITED STATES PATENTS

| | | | |
|---|---|---|---|
| 1,875,673 | 9/1932 | Stockstill | 166/55 |
| 2,169,113 | 8/1939 | Sheppard | 72/453 |
| 3,117,615 | 1/1964 | Graven | 72/416 |
| 3,207,406 | 9/1965 | Bowman | 100/231 |
| 3,249,041 | 5/1966 | Johnson | 100/231 |
| 3,266,287 | 8/1966 | Gill | 72/416 |
| 3,301,035 | 1/1967 | Gill | 72/404 |
| 3,326,029 | 6/1967 | Porter | 72/453 |
| 3,789,689 | 2/1974 | Mace | 166/55 |

*Primary Examiner*—C. W. Lanham
*Assistant Examiner*—Gene P. Crosby
*Attorney, Agent, or Firm*—Cushman, Darby & Cushman

[57] ABSTRACT

An apparatus for constricting or closing a conduit comprises a pair of generally parallel clamp frames opening in the same direction and disposed at a separation such as to accommodate the conduit between them, the clamp frames being formed in one side of their opening with a recess in which fits a stationary clamp member and being secured on their other side to a fluid operated ram that actuates a movable clamp member towards the stationary clamp member. After operation of the ram the two clamp members are fastened together, eg by bolts, and then the ram is retracted. The clamp members can then be removed from the clamp frames.

1 Claim, 3 Drawing Figures

APPARATUS FOR CONSTRICTING OR CLOSING CONDUITS

This invention relates to an apparatus for constricting or closing conduits, especially those containing hot gases or liquids.

Thermal treatment of hydrocarbons, for example in the production of gases containing carbon oxides and hydrogen or from which olefines such as ethylene or styrene are to be recovered, is commonly effected by passing them with steam through heated tubes that may contain catalyst. Such tubes may be 6–90 meters long and 2 to 25 cm in internal diameter and are suspended in a furnace, which may contain several hundred of them. They may or may not be straight. They are connected usually to inlet and outlet headers either directly or by way of small-diameter relatively flexible tubes (often known as "pigtails"). If for any reason, such as mechanical failure or catalyst blockage, a tube has to be isolated, this can be effected by squeezing the tube itself or its pigtails to a state of complete or substantial closure. The remainder of the tubes in the furnace continue in operation.

The same method can be applied, for example, to a plant having a multiplicity of tubes carrying steam or boiler feed water or coolant and enables the plant to continue to operate should a small number of tubes become defective.

We describe this method and apparatus therefor in our UK Specification No. 1089204. We have now devised an improved apparatus capable of use in furnaces in which the tubes are too close together to permit the use of the apparatus of UK Pat. No. 1089204; in preferred forms the new apparatus is capable of applying a greater squeezing force than was previously in general use.

The invention provides a framework for an apparatus for constricting or closing a conduit which comprises a pair of generally parallel clamp frames opening in the same direction, a fixed bridging means on one side of the clamp openings locating the clamp frames at a mutual separation such as to accommodate the conduit between them, the bridging means being formed so as to be securable to a fluid-operated ram assembly having a traverse from one side towards the further side of the clamp openings, the clamp frames being formed with locating means for a stationary clamp member on the further side and with means for supporting a guide or guides for a movable clamp member actuated by the ram towards the stationary clamp.

The apparatus comprises the said framework along with a. the fluid-operated (e.g. hydraulic) ram assembly: conveniently the fixed bridging means is secured to the barrel of the ram assembly;

b. the stationary clamp member;

c. the movable clamp member;

d. the guide or guides for the movable clamp member; and e. means such as bolts, for holding the clamp members together after the constricting or closing operation.

The clamp members can be profiled so as to apply a closer squeeze to the centre of the conduit, for example by means of a convex curve of large radius parallel to the axis of the member.

If the conduits to be constricted or closed are at temperatures in the range 500°–1000°C, the apparatus should be made from a metal or alloy suitably resistant to heat.

One preferred form of the invention is shown in the accompanying drawings in which FIG. 1 is a sectional side elevation on a plane 1:1 of FIG. 2 at the axis of the ram;

Figure 1:
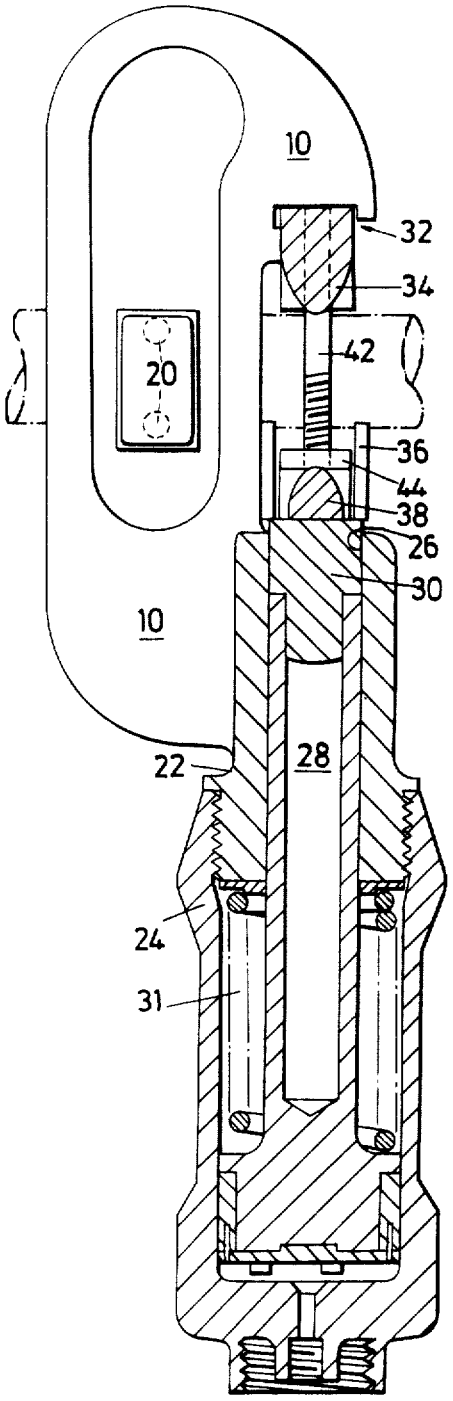
Figure 2:
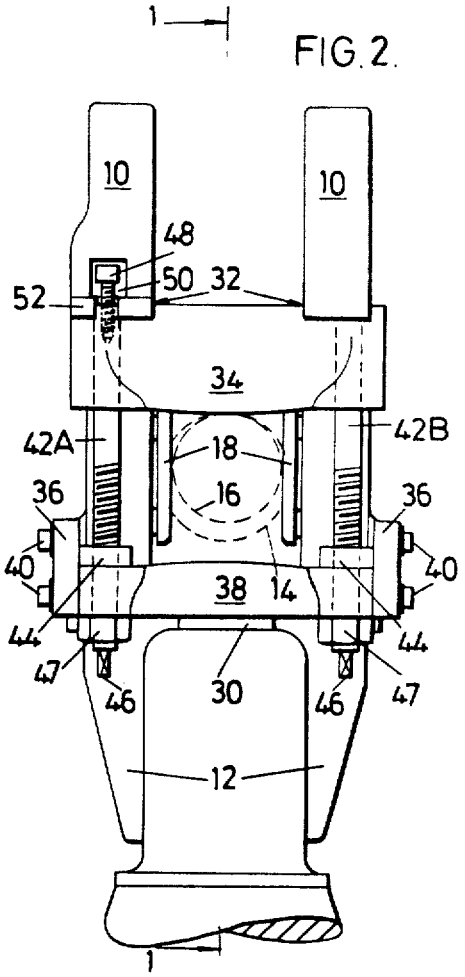
FIG. 2 is a front elevation of the device.
Figure 3:
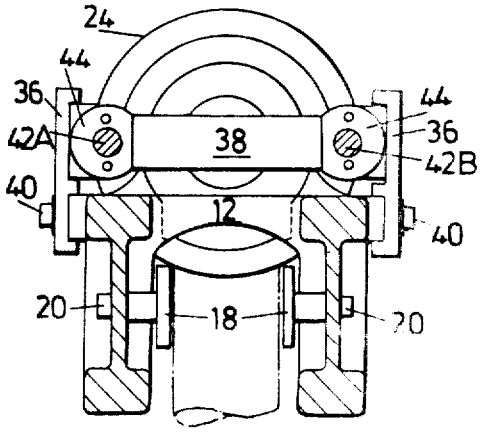
FIG. 3 is a plan section at the level of the movable clamp member.

The figures show the apparatus as assembled about the conduit preparatory to closing it. Clamp frames 10 are formed integrally with fixed bridging piece 12—thus together they constitute a bifurcated clamp frame. The frames can accommodate conduits of large diameter 14 or of small diameter 16 with the aid if locating pieces 18, which are interchangeable, are sized to suit the diameter of the conduit and are held in place by means of screws 21 on the outside of the frames. Downward extension 22 of bridging piece 12 is formed externally with male threads which engage with female threads in barrel 24 of the hydraulic ram assembly, and internally has smooth walls 26 to act as a guide for ram 28 and ram extension 30. Within the barrel, spring 31 is provided in order to return the ram to its pre-operative position when hydraulic pressure is released. Each clamp frame 10 is formed with recess 21 (the two recesses differ as described below) to locate stationary clamp member 34 and carries a guide 36 for movable clamp member 38. Each guide 36 is bolted at 40 to its clamp frame. Bolts 42A and 42B connect the two clamp members and carry stops 44 to limit the mutual approach of the members. Stops 44 are of a thickness appropriate to the thickness of the conduit walls. Stationary clamp member 34 is tapped to secure the ends of the bolts, and these can be screwed in by applying a spanner to square shank ends 46. Each bolt is threaded externally to receive nuts 47. Bolt 42A is tapped to receive screw 48, which projects into recess 50 to locate clamp member 34 against lateral movement. Recess 32 on this side has its lip in the form of screwed-on piece 52.

In operating the apparatus, the two clamp members are assembled on one bolt, 42A, with screw 48 in position. Movable clamp member 38 is laid in guides 36. Stationary clamp member 34 is disposed short of recesses 32, but with screw 48 in recess 50. Bolt 42A is tightened into clamp member 34 and a nut 47 applied. Clamp member 34 is then turned to the "gate-open38 position and, after placing the assembly over the conduit, returned to the "gate-shut" position. Bolt 42B, with nut 47 previously applied, is tightened into stationary clamp member 34. Hydraulic pressure is then applied to the ram, which drives clamp member 38 towards clamp member 34, until the conduit is adequately squeezed. Nuts 47 are tightened, the hydraulic pressure released and the clamp frame assembly lifted away, leaving the clamp members in position.

The apparatus as shown suitably has a ram pressure rating of 10000 psi and can deal with conduits of overall diameter up to 2.375 inches.

I claim:

1. An apparatus for constricting or closing a conduit which comprises a framework comprising a pair of generally parallel clamp frames opening in the same direction, a fixed bridging means on one side of the clamp openings locating the clamp frames at a mutual separation such as to accommodate the conduit between them, a fluid-operated ram mounted so as to be movable from one side towards the further side of the clamp openings, the barrel of the ram being secured to the fixed bridging means, means formed in the further side of the clamp frames for detachably locating a stationary clamp member, a stationary clamp member detachably located by such locating means and bridging the clamp members at the further side, a movable clamp member detachably connected to the ram and actuable by the ram towards the stationary clamp member, means effective to guide the movable clamp member towards the stationary clamp member, and bolt means effective as additional guide means for the movable clamp member during the constricting or closing operation and tightenable after the said operation to hold the clamp members together after release of the pressure on the ram.

* * * * *